US007905235B2

(12) United States Patent
Patel

(10) Patent No.: US 7,905,235 B2
(45) Date of Patent: Mar. 15, 2011

(54) CIGARETTE ROLLING MACHINE

(76) Inventor: Shargio Patel, Rolling Meadows, IL (US)

( * ) Notice: Subject to any disclaimer, the term of this patent is extended or adjusted under 35 U.S.C. 154(b) by 435 days.

(21) Appl. No.: 12/125,452

(22) Filed: May 22, 2008

(65) Prior Publication Data

US 2009/0288666 A1 Nov. 26, 2009

(51) Int. Cl.
*A24C 1/22* (2006.01)

(52) U.S. Cl. ..... 131/57; 131/70; 131/74; 131/75

(58) Field of Classification Search ..... None
See application file for complete search history.

(56) References Cited

U.S. PATENT DOCUMENTS 4,572,216 A * 2/1986 Josuttis et al. ..... 131/70

* cited by examiner

*Primary Examiner* — Richard Crispino
*Assistant Examiner* — Phu H Nguyen
(74) *Attorney, Agent, or Firm* — Justin Lampel

(57) ABSTRACT

The present invention generally relates to a compact electrical cigarette rolling machine. The machine is particularly suitable for easily and quickly rolling tobacco into a cigarette. The tobacco is placed into a holding reservoir having tapered walls which help guide the tobacco into a rotating coil located near the bottom of a holding reservoir. The rotating coil then forces the tobacco through a hollow tube and into a pre-rolled paper cigarette in a compact and efficient manner. The machine has a support bar which allows the tobacco to become easily compacted within the paper of the cigarette without the pre-rolled paper becoming accidentally dislodged. The user may control how tightly the tobacco is packed within the cigarette by use of a control knob.

6 Claims, 3 Drawing Sheets

1
5
23
2
50
60
7
6
46
30
32
21
20
8
40
13
14
14
10
30
31
47
45
2
72
70
71
73
71
101
4

1
5
2
60
50
32
10
46
30
11
40
41
12
8
13
31
30
95
45
91
72
96
90
70
93
71
80
100
101
92
4

CIGARETTE ROLLING MACHINE

BACKGROUND OF THE INVENTION

The present invention generally relates to a compact electrical cigarette rolling machine. The machine is particularly suitable for easily and quickly rolling tobacco into a cigarette. The tobacco is placed into a holding reservoir having tapered walls which help guide the tobacco into a rotating coil located near the bottom of a holding reservoir. The rotating coil then forces the tobacco through a hollow tube and into a pre-rolled paper cigarette in a compact and efficient manner. The machine has a support bar which allows the tobacco to become easily compacted within the paper of the cigarette without the pre-rolled paper becoming accidentally dislodged. The user may control how tightly the tobacco is packed within the cigarette by use of a control knob.

Cigarette rolling machines have been around for a long time. To work most of the existing cigarette rolling machines, tobacco is typically placed into a reservoir and then the user, either manually or automatically, rolls and compressed the tobacco within rolling paper. For example, U.S. Pat. No. 6,345,624 to Kastner discloses a compact cigarette making machine for compacting and inserting a quantity of tobacco into a preformed cigarette tube is described. A tobacco receiving member is slidably retained within a base and movable longitudinally thereon to load tobacco into a cigarette tube secured to a nipple at its forward end. A cover is pivotally secured to the rearward end of the tobacco receiving member and slidable therewith respect to the base. The cover is pivotally movable from an open position to a closed position overlying the tobacco receiving member. The cover is substantially of the same width as the base and has a pair of opposed inner tongues engagable under a respective elongated flange which projects inside the open channel-shaped base from opposed side walls thereof when the tobacco receiving member is retracted rearwardly over the base. Accordingly, the cigarette making machine is very compact in dimension and can be easily carried by a user person.

U.S. Pat. No. 4,771,793 to Kastner discloses a compact cigarette making machine is disclosed. The machine consists of a hollow channel-shaped base carrying a tobacco receiving member which is longitudinally slideable within the base. A cover is pivotally secured to the tobacco receiving member and is slidable therewith respect to the base. An elongate tobacco injection spoon is removably carried by the base and is stationary therewith, as a hollow circular nipple for reception of a preformed cigarette tube is provided at the forward end of the tobacco receiving member. A tobacco receiving slot is provided in the tobacco receiving member and the cover is provided with a projection for compacting tobacco positioned in the slot. With the cover closed and tobacco positioned in the slot and a cigarette tube positioned on the nipple, rearward movement of the cover and tobacco receiving member with respect to the base results in the injection of a compacted wad of tobacco into the cigarette tube. The spoon and nipple which are the components most subject to gumming by the tobacco are easily removed for cleaning or replacement.

U.S. Pat. No. 3,741,220 to Meimunger discloses a device for filling a tube of cigarette paper with tobacco to make a cigarette including a casing, a slide, a chamber for tobacco formed in the slide, a nozzle mounted on the slide and communicating with the chamber, a clamp for holding the tube of paper on the nozzle, compression means mounted on the slide wherein tobacco in the chamber can be compressed into a plug by the compression means, and by manually pushing on the slide portion to reduce the chamber capacity, the plug is forced through the nozzle into the tube of cigarette paper thus forming a cigarette. The compression means is provided with a locking component cooperable with the slide to hold the compression means in a compressing position.

However, these existing cigarette rolling machines fail to provide the benefits of the present cigarette rolling machine. A need, therefore, exists for an improved automatic cigarette rolling machine which allows the easy and quick insertion of tobacco into cigarette paper. Further, a need exists for an improved cigarette rolling machine which has a support arm for preventing the unintentional movement of the paper during the insertion process.

SUMMARY OF THE INVENTION

The present invention generally relates to a compact electrical cigarette rolling machine. The machine is particularly suitable for easily and quickly rolling tobacco into a cigarette. The tobacco is placed into a holding reservoir having tapered walls which help guide the tobacco into a rotating coil located near the bottom of a holding reservoir. The rotating coil then forces the tobacco through a hollow tube and into a pre-rolled paper cigarette in a compact and efficient manner. The machine has a support bar which allows the tobacco to become easily compacted within the paper of the cigarette without the pre-rolled paper becoming accidentally dislodged. The user may control how tightly the tobacco is packed within the cigarette by use of a control knob.

An advantage of the present invention is to provide a cigarette rolling machine which is compact.

An advantage of the present invention is to provide a cigarette rolling machine which is easily transported.

Another advantage of the present invention is to provide a cigarette rolling machine which has a coil for forcing tobacco into a pre-rolled cigarette.

A further advantage of the present invention is to provide a cigarette rolling machine in which the user can control how tightly tobacco is packed into the cigarette.

A still further advantage is to provide a cigarette rolling machine which has a support arm for securing the pre-rolled paper cigarette during the filing of the cigarette with tobacco.

And yet another advantage of the present invention is to provide a cigarette rolling machine which has a tapered hollow tube for inserting the pre-rolled cigarette onto the machine for filling with tobacco.

And still another advantage of the present invention is to provide a cigarette rolling machine which allows the creation of filter and filter-free cigarettes.

For a more complete understanding of the above listed features and advantages of the cigarette rolling machine, reference should be made to the following detailed description of the preferred embodiments and to the accompanying drawings. Further, additional features and advantages of the present invention are described in, and will be apparent from, the detailed description of the preferred embodiments and from the drawings.

DETAILED DESCRIPTION OF THE PREFERRED EMBODIMENTS

The present invention generally relates to a compact electrical cigarette rolling machine. The machine is particularly suitable for easily and quickly rolling tobacco into a cigarette. The tobacco is placed into a holding reservoir having tapered walls which help guide the tobacco into a rotating coil located near the bottom of a holding reservoir. The rotating coil then forces the tobacco through a hollow tube and into a pre-rolled paper cigarette in a compact and efficient manner. The machine has a support bar which allows the tobacco to become easily compacted within the paper of the cigarette without the pre-rolled paper becoming accidentally dislodged. The user may control how tightly the tobacco is packed within the cigarette by use of a control knob.

Figure 1:
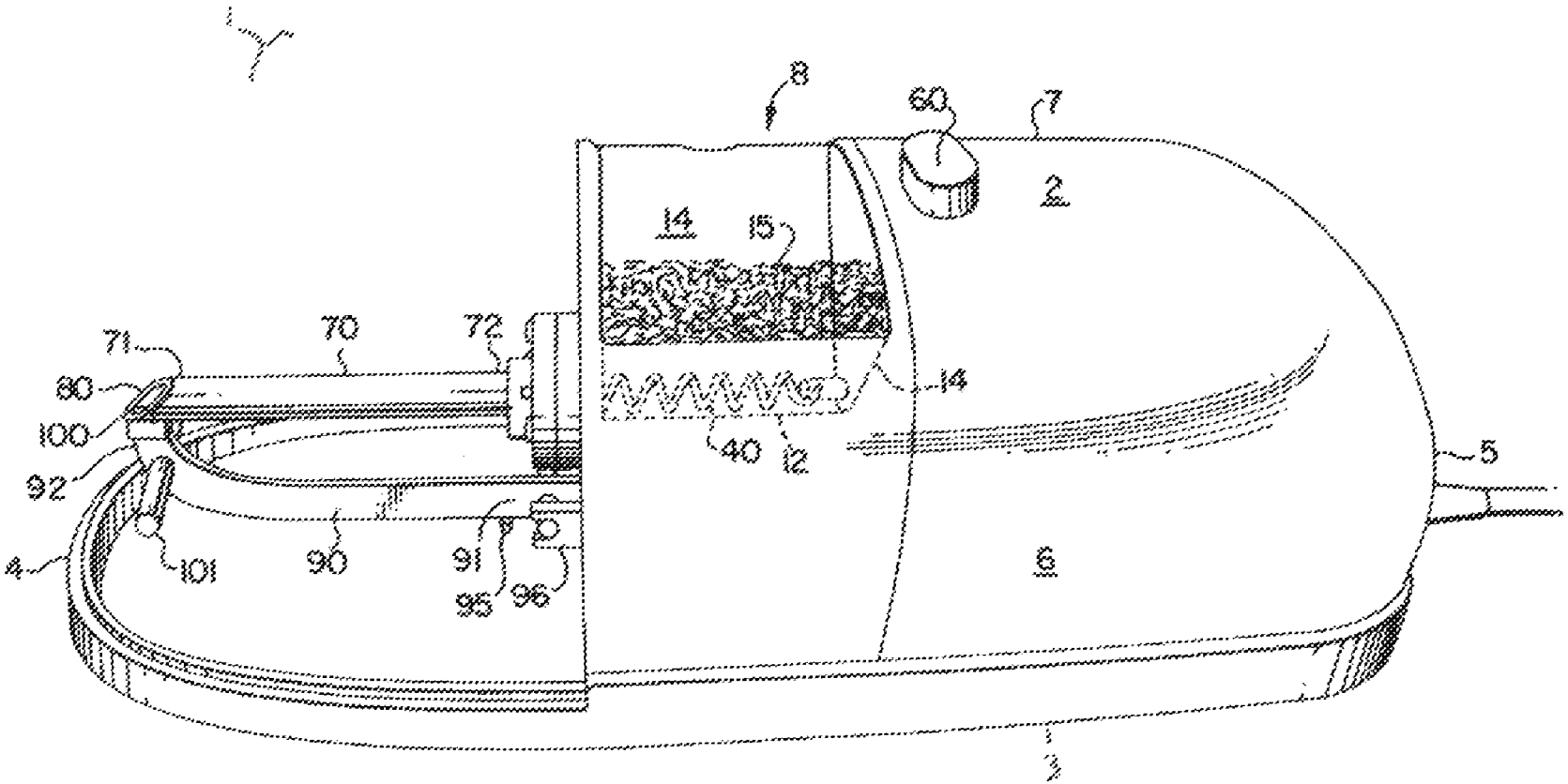
FIG. 1 illustrates a side perspective view of the cigarette rolling machine of the present invention.
Figure 2:
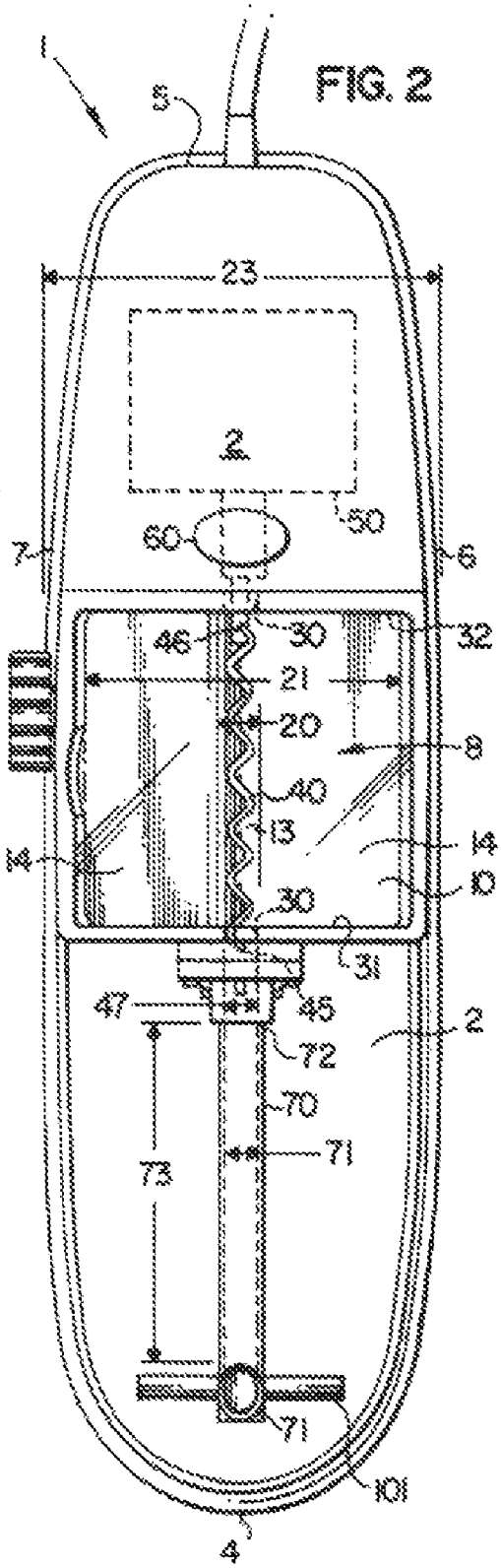
FIG. 2 illustrates a top plan view of the cigarette rolling machine of the present invention.
Figure 3:
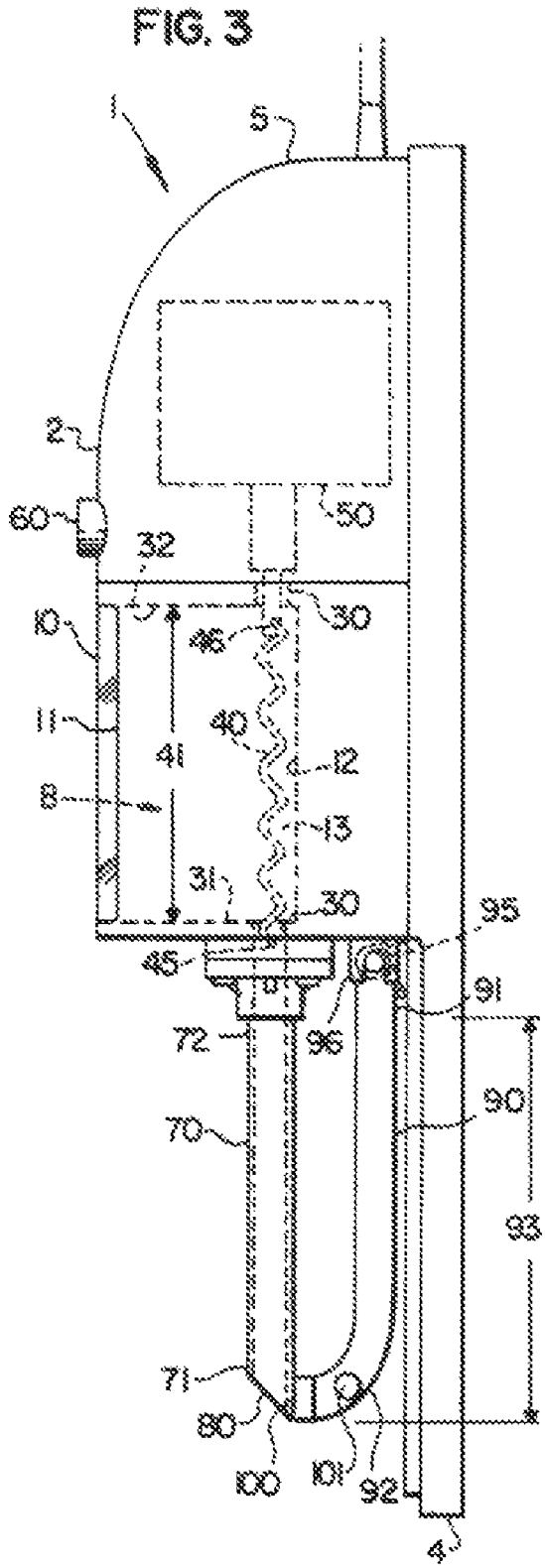
FIG. 3 illustrates a side view of the cigarette rolling machine of the present invention.
Figure 4:
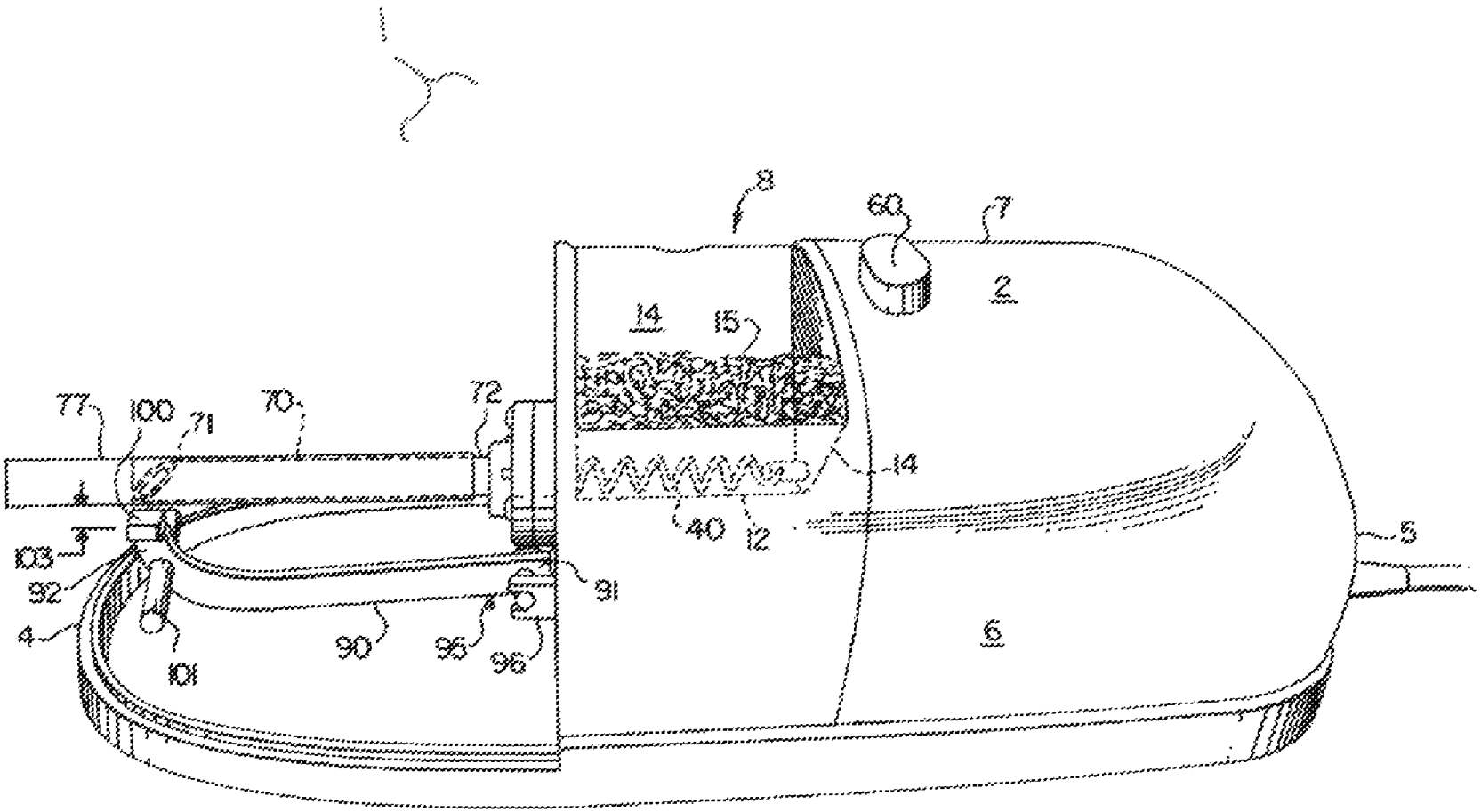
FIG. 4 illustrates a side view of the cigarette rolling machine of the present invention.

Referring now to FIG. 1, the cigarette rolling machine 1 may have a top side 2, a bottom side 3, a front 4, a back 5 a first side 6 and a second side 7. The top side of the cigarette rolling machine 1 may have a reservoir 8. The reservoir 8 may have a width 21 which is almost as large as a width 23 of the cigarette rolling machine 1. The reservoir 8 may be a concave portion which extends from the top side 2 of the cigarette machine 1 toward the interior of the cigarette machine 1. A protective cover 10 may cover an opening to the reservoir 8. The protective cover 10 may be slightly larger than the size of the opening of the reservoir 8. The protective cover 10 may prevent dust or other unintended substances from entering the interior of the reservoir 8.

The reservoir 8 may have a top side 11 and a bottom side 12. An injection tunnel 13 may be located at the bottom side 12 of the reservoir 8. The injection tunnel 13 may have a width 20 which is less than the width 21 of the reservoir 8. Walls 14 of the reservoir 8 may be tapered inward toward the injection of the tunnel 13 of the reservoir 8. The walls 14 of the reservoir 8 may allow a substance, namely, tobacco 15 to be directed into the injection tunnel 13 by the tapered walls 14 of the reservoir 8. More specifically, gravity may force the tobacco 15 into the injection tunnel 13. In addition, a person may force the tobacco 15 into the injection tunnel 13 my the force of, for example, a finger or another object.

An opening 30 may be present at a front 31 of the injection tunnel 13 and an opening 30 may be present at a back 32 of the injection tunnel 13. A coil 40 may be present in the injection tunnel 13. The coil 40 may have a first end 45 and a second end 46. The coil 40 may extend the throughout a length 41 of the injection tunnel 13. Further, the width of the coil 40 may be slightly less than a diameter 47 of the openings 30 at the front 31 of the injection tunnel 13 and the back 32 of the injection tunnel 32 such that the coil 40 may be inserted through the openings 30.

The second end 46 of the coil 40 may extend through the opening of the back 32 of the injection tunnel 13 and into the interior of the cigarette rolling machine 1. Within the interior of the cigarette rolling machine 1 may be a motor 50 which may not be visible when viewing the apparatus. The motor 50 of the cigarette rolling machine 1 may rotate the coil 40. The mechanics of a motor are generally known in the art and will not be discussed in further detail. A power source, such as, for, example, an AC or DC connection may power the motor. A power button 60 may be located, for example, on the top side 2 of the cigarette rolling machine 1 and may allow a user to activate the motor 50 and thereby rotate the coil 40.

The first end 45 of the coil 40 may extend through the opening 30 at the front 31 of the injection tunnel 13. When tobacco 15 is placed through the top side 11 opening and into the reservoir 8, the tobacco 15 is directed downward by gravity against the tapered walls 14 into the injection tunnel 13. It may be helpful at times to provide additional pressure to push the tobacco 15 into the injection tunnel 13. Once in the injection tunnel 13 area, the rotation of the coil 40 may force the tobacco 15 toward the front of the injection tunnel 13 and out the opening 30 of the injection tunnel 13 opposite the opening 30 leading to the motor 50.

A hollow tube 70 may be located toward the front 4 of the cigarette rolling machine 1. The hollow tube 70 may be have a diameter 71 which is substantially equal to the diameter 47 of the opening 30 such that a portion of the first end 45 of the coil 40 may at least partially extend through the opening 30 of the reservoir 8 and into the hollow tube 70. When tobacco 15 is moved forward by the coil 40 the tobacco 15 may be forced forward through the opening 30 of the injection tunnel 13 and through the hollow tube 70.

The hollow tube 70 may have a first end 71, a second end 72, a length 73 and a width 74. As stated above, the second end 72 of the hollow tube 70 may be connected to the opening 30 of the injection tunnel 13. The length 73 of the hollow tube 70 is preferably equal to at least the length 75 of a typical cigarette 76.

To use the apparatus, a person places a pre-rolled paper 77 cigarette lacking tobacco 15 over the hollow tube 70. If the user desires to make a cigarette having a filter, the filter end of the cigarette is placed toward the front end 4 of the apparatus so that the filter does not prevent the pre-rolled paper 77 from being inserted over the hollow tube 70. Preferably, the width of the pre-rolled cigarette is slightly larger than the width 74 of the hollow tube 70 such that the pre-rolled paper 77 fits snugly over the hollow tube 70.

During use, tobacco 15 is forced through the hollow tube 70 and out an opening 78 at the first end 71 of the hollow tube 70. Tobacco 15 exiting the hollow tube 70 then enters the pre-rolled paper 77 cigarette in the tightly packed manner. A user may control how tight the tobacco 15 is packed into the pre-rolled 77 cigarette by controlling the amount of time the apparatus is in the on mode and also by the speed of the coil 40 (which may be controlled by a speed knob on the apparatus).

If the user is making a cigarette having a filter, the tobacco 15 will be forced through the hollow tube 70 and against the filter. Because the tobacco 15 is still being forced forward, the packed tobacco 15 forces the filter forward and the pre-rolled paper 77 cigarette is quickly and effectively filled with the tobacco 15. If the user is making a cigarette lacking a filter, the user may place his/her finger (or other object) over the opening in the pre-rolled paper 77 cigarette such that the tobacco 15 pushes against the object, forces the object forward, and in the process fills the pre-rolled paper 77 cigarette in the same manner.

The hollow tube 70 of the cigarette rolling machine 1 may have a tapered portion 80 at the first end 71. The tapered portion 80 may allow the user to more easily insert the pre-rolled paper 77 cigarette over the hollow tube 70.

A support arm 90 may be located near the front 4 of the cigarette rolling machine 1. The support arm 90 may have a first end 91, a second end 92 and a length 93. The length 93 of the support arm 90 may be substantially similar to the length 73 of the hollow tube 70. The support arm 90 may be spring loaded and may prevent the unintentional movement of the pre-rolled paper 77 cigarette during the insertion of the tobacco 15 into the paper. More specifically, a spring 95 may connect, for example, the first end 91 of the support arm 90 to a stationary object 96 located, for example, within the interior of the cigarette rolling machine 1. The spring 95 may force the second end 92 of the support arm 90 upward so that a portion of the support arm 90 is in contact with the hollow tube 70. More specifically, the second end 92 of the support arm 90 may be forced up against, for example, the first end 71 of the hollow tube 70. At rest, the support arm 90 may be spring activated to force itself against the hollow tube 70.

The support arm 90 may be arched upward so that only a small flat portion 100 of the support arm 90 is in contact with the hollow tube 70. A grasping knob 101 may be present near the second end 92 of the support arm 90 so that a user may manually grasp the grasping knob 101 to move the support arm 90 downward to separate the support arm 90 from the hollow tube 70.

To use the cigarette rolling machine 1, the user presses down on the grasping knob 101 so that the support arm 90 is no longer in contact with the hollow tube 70. When pressed down, a space 103 is created between the support arm 90 and the hollow tube 70. In this down position, the user inserts the pre-rolled paper 77 cigarette over the hollow tube 70 until the filter of the cigarette is firm against the first end 71 of the hollow tube 70. The user then releases the pressure on the grasping knob 101 so that the support arm 90 is forced upward by the spring 95. In this position, the support arm 90 holds the pre-rolled paper 77 cigarette firmly over the hollow tube 70. When tobacco 15 is forced out of the first end 71 of the hollow tube 70, the support arm 90 provides pressure to prevent the pre-rolled 77 cigarette form being prematurely forced off the hollow tube 70 by the force of the tobacco 15 filling up the pre-rolled paper 77 cigarette. Once the pre-rolled paper 77 cigarette is fill of tobacco 15 to the satisfaction of the user, the user simply pulls the remainder of the tobacco 15 filled cigarette off the hollow tube 15.

Although embodiments of the present invention are shown and described therein, it should be understood that various changes and modifications to the presently preferred embodiments will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A rolling machine for tobacco comprising:

a housing having an interior reservoir wherein a portion of the interior reservoir is accessible through an opening and wherein tobacco is inserted through the opening;

a second opening at a front of the interior reservoir wherein the opening at the front of the interior reservoir allows the passage of tobacco from the interior reservoir to the exterior of the housing;

a coil or rod located near the bottom of the internal reservoir wherein the coil or rod rotates and forces tobacco out the internal reservoir though the second opening; and a hollow tube having a length located near a front of the machine wherein tobacco exiting the internal reservoir through the second opening passes through the hollow tube and a support bar having a first end and a length wherein the length of the support bar is substantially similar to the length of the hollow tube and wherein the first end of the support bar is forced against a front end of the hollow tube by means of a spring and wherein a user forces the support bar away from the hollow tube to slide the paper of a cigarette over the hollow tube.

2. The rolling machine of claim 1 further comprising:

a grasping rod for manually moving the support bar with respect to the hollow tube.

3. The rolling machine of claim 1 further comprising:

a motor connected to the coil or rod wherein the motor rotates the coil or rod.

4. The rolling machine of claim 1 wherein the interior reservoir has tapered walls for directing the tobacco toward the bottom of the internal reservoir.

5. The rolling machine of claim 1 further comprising:

a removable protective cover for covering the opening of the internal reservoir.

6. The rolling machine of claim 1 further comprising:

a control apparatus for controlling the speed of the rotation of the coil or rod.

* * * * *